United States Patent [19]

Toelke

[11] 4,207,756

[45] Jun. 17, 1980

[54] TENSION SHOCK ABSORBER DEVICE

[75] Inventor: Lester Toelke, Houston, Tex.

[73] Assignee: Well Control, Inc., Houston, Tex.

[21] Appl. No.: 844,233

[22] Filed: Oct. 21, 1977

[51] Int. Cl.[2] ..... F16D 3/00

[52] U.S. Cl. ..... 64/23; 175/299

[58] Field of Search ..... 64/23, 23.5; 175/299, 175/321; 267/137, 73

[56] References Cited

U.S. PATENT DOCUMENTS

| | | | |
|---|---|---|---|
| 1,900,932 | 3/1933 | Hollestelle | 64/23 |
| 2,240,519 | 5/1941 | Reed | 175/321 |

FOREIGN PATENT DOCUMENTS

| | | | |
|---|---|---|---|
| 201807 | 8/1923 | United Kingdom | 175/299 |

*Primary Examiner*—Albert W. Davis, Jr.
*Assistant Examiner*—Gerald Anderson

[57] ABSTRACT

Well bore drilling shock absorber device for absorbing drill bit vibratory displacement shock, especially in elevated temperature formation drilling, in which the pair of slidably associated elements, e.g. telescoping inner mandrel and outer housing, interconnected for common rotation for drilling purposes and relative reciprocal displacement longitudinally for shock absorbing purposes, and adapted to be interposed operatively between a drill string thereabove and a drill bit therebelow, is provided with longitudinally resilient mechanical tension shock absorbing means, e.g. linear means or cable means such as wire rope, rods, tubes, chains, etc., of metal or plastic, interposed therebetween and operatively interconnecting the elements in longitudinally resilient suspension relation, whereby to absorb, suppress and even isolate, under tension, and substantially independently of the ambient thermal and mechanical, pneumatic, hydraulic and/or hydrostatic pressure conditions, dynamic longitudinal stress or load corresponding to vibratory drill bit displacement shock acting through one of the elements, optionally with a portion of the interior of the device in restricted open flow communication with the ambient exterior drilling fluid for exerting a counterpressure operatively thereon, and preferably with such shock absorbing means disposed in a sealed chamber defined between such elements and containing a lubricant, optionally with pressure balancing means being provided for maintaining such chamber in indirect pressure flow-communication with the ambient external pressure.

36 Claims, 7 Drawing Figures

TENSION SHOCK ABSORBER DEVICE

Figure 1A:
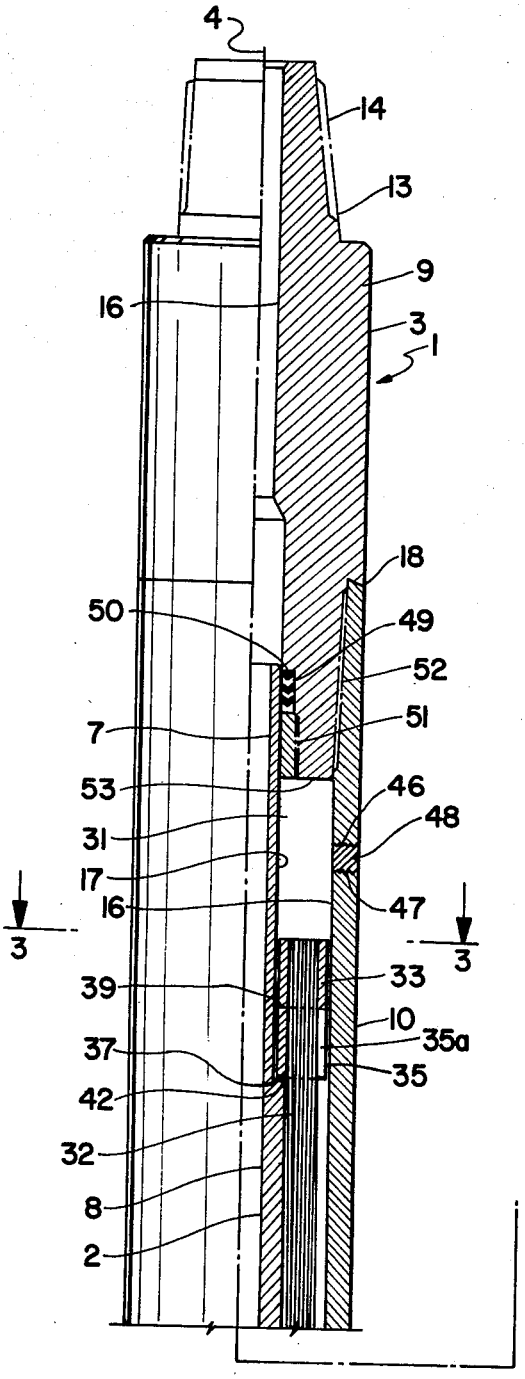

The present invention relates to a shock absorbing device for use in well bore drilling for absorbing drill bit vibratory displacement shock, utilizing resilient tension shock absorbing means, and more particularly mechanical resilient shock absorbing cable means operatively interconnecting the functional elements of the device in resilient suspension relation.

A prime problem in well bore drilling operations concerns the maintaining of the mechanical integrity of the drill collar string acting downwardly on the drill bit in the well bore and through which rotary motion is transmitted to the bit at the bottom end of the well bore. One of the principal factors for the failure of drill bit bearings and drill collar threads used for interconnecting the associated components of the drill string, is the severe vibration caused by the bit during drilling, especially where relatively hard underground formations are encountered. For example, such vibration may exceed 180 cycles per minute at amplitudes as high as ¾ of an inch. The resultant energy and other mechanical stresses developed during such drilling operations often prematurely damage the bit bearings and fatigue the collar connections, eventuating in failure of these parts.

Various shock absorber devices have been developed to reduce the problem involved, but these generally contemplate elastomeric material, compressible fluid or gas, or even compression spring arrangements, as the shock absorbing agent (see for instance U.S. Pat. Nos. 3,128,102; 3,323,327; 3,406,537 and 3,949,150). However, these various known shock absorbing agents must be provided in a chamber within the device closed off by sealing means to isolate the shock absorbing chamber from the ambient drilling fluid in the down hole end of the well bore.

Generally, the known elastomeric materials are temperature sensitive and subject to accelerated degradation at temperatures well below about 400° F. While the drilling fluid supply to the drill bit, according to conventional technique, provides some cooling effect, the frictional energy developed by the operation of the shock absorbing agent in the closed chamber together with the effect of the ambient formation temperature, soon lead to elevated temperature conditions which often exceed the limits of the shock absorbing means and the sealing means provided, whereupon failure thereof, leakage and attendant adverse effect on the components rapidly follow.

As a rule, shock absorbing devices which require positive closed sealing arrangements, become less reliable in operation as the temperature increases, even at temperatures as low as 250° F., e.g. in the case of urethane materials. Consequently, a leaking seal developed under such conditions can cause the shock absorber device to malfunction or lead possibly to a wash-out at the seal, requiring pulling up the drill collar string and associated components for repair. The above discussed problems may be measured for instance in practical terms not only involving extra costs in equipment and repair, but also in relation to labor and time lost.

It is among the objects and advantages of the present invention to overcome the foregoing drawbacks and disadvantages, and to provide a shock absorber device for use in well bore drilling to absorb drill bit vibratory displacement shock, constituting a unique combination of associated long lasting parts and elements, efficient and durable in operation as well as inexpensive and simple in construction, and especially under a wide range of sustained ambient formation temperature and mechanical, pneumatic, hydraulic and/or hydrostatic operating pressure conditions, as may be encountered during down hole bottom end drilling in any given well bore.

It is among the further objects and advantages of the present invention to provide a mechanical shock absorber device of the foregoing type such as in the form of longitudinally resilient tension shock absorbing means, whereby to absorb, suppress and even isolate, under tension, dynamic longitudinal stress or load corresponding to vibratory drill bit displacement shock, substantially independently of the ambient thermal and pressure conditions during drilling operations.

It is among the still further objects and advantages of the present invention to provide such a mechanical shock absorber system which interconnects the functional elements of the device in longitudinally resilient suspension relation, and preferably while disposed in a chamber defined within and/or between such functional elements, which chamber is preferably sealed off from open flow communication with the ambient drilling fluid at the exterior of the device and contains a lubricant, e.g. in operative lubricating contact with such tension shock absorbing means.

Figure 1B:
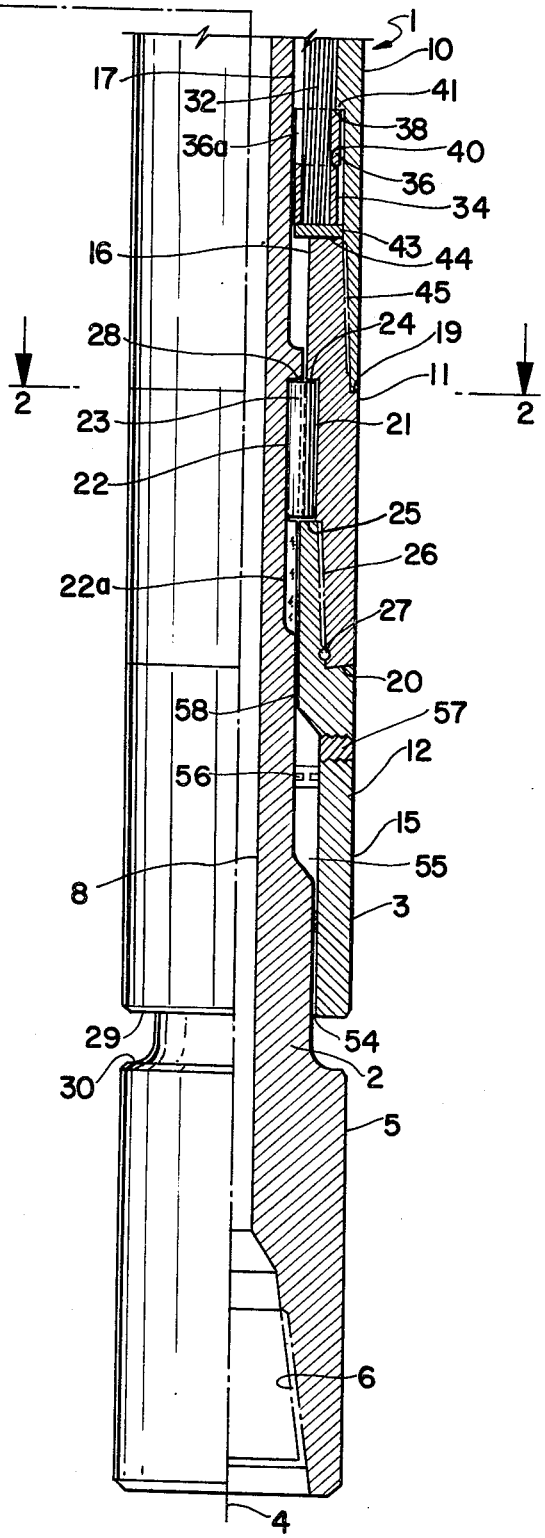
Figure 2:
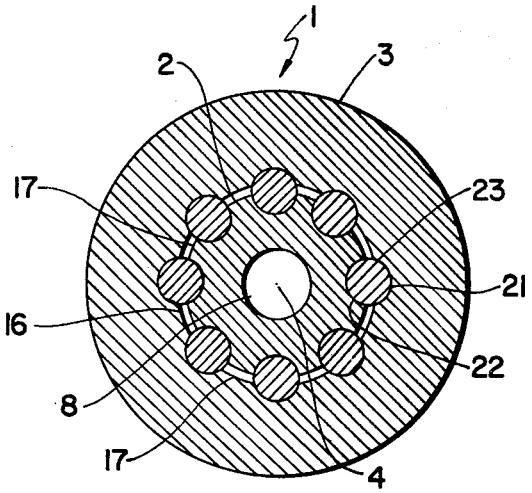
Figure 4:
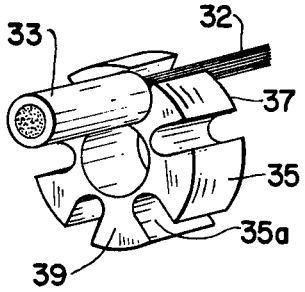
Figure 5:
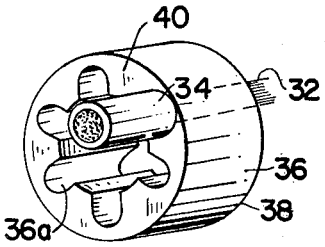
Figure 6:
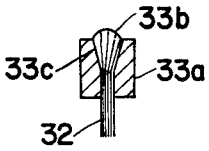

Other and further objects and advantages of the present invention will become apparent from a study of the within specification and accompanying drawings, in which:

FIGS. 1*a* and 1*b* are schematic partial sectional views of tandem parts together constituting an embodiment of a drill string shock absorber device according to the present invention, FIG. 2 is a schematic sectional view taken along the line 2—2 of FIG. 1*b*, FIG. 2 is a schematic sectional view taken along the line 3—3 of FIG. 1*a*, FIGS. 4 and 5 are schematic perspective views of the retaining rings for mounting the ends of the tension shock absorbing means in the device of FIG. 1, and FIG. 6 is a schematic sectional view of an alternative form of the ferrule end connection of the tension shock absorbing means of the invention.

Broadly, the present invention concerns a drill bit shock absorber device for use in well bore drilling to absorb drill bit vibratory displacement shock, in which the shock absorbing means which is subject to pressure, i.e. load, operatively between the relatively longitudinally or axially displaceable associated elements constituting the functional parts of the device, is provided in the form of resilient tension shock absorbing means. Advantageously, such shock absorbing means are longitudinally resilient mechanical tension shock absorbing linear means or cable means, e.g. in the form of wire rope, rods, tubes, chains, etc. of metal or plastic material, e.g. nylon, but in any case will be capable of effectively absorbing strain in internal longitudinal direction under tension.

The device generally contemplates a pair of slidably associated longitudinal elements interengagingly interconnected for common rotation about a longitudinal axis and for selectively limited relative reciprocal displacement longitudinally with respect to each other along such axis. In the usual way, one of such elements is operatively connectable to a component of a drill string thereabove and the other of such elements is operatively connectable to the drill bit therebelow. Significantly, the resilient tension shock absorbing means is interposed between the elements and operatively interconnects the elements in resilient suspension relation for absorbing under tension dynamic longitudinal stress or load corresponding to vibratory drill bit displacement shock acting through one of the elements, e.g. that connectable to the drill bit.

Preferably, the resilient tension shock absorbing means include longitudinally resilient linear members, such as multiple strand metal wire rope, or rods, tubes, chains, cables, etc. of appropriate type, interconnecting the elements at opposite longitudinally spaced apart points and arranged to absorb under tension longitudinally therethrough such dynamic longitudinal stress. In accordance with a desirable feature of the present invention, a plurality of such linear means, e.g. in the form of individual linear members of the foregoing type, is disposed in peripherally spaced apart relation to each other and commonly interconnect the elements at such opposed longitudinally spaced apart points.

With regard to a further feature of the invention, corresponding opposed retaining means are provided on the respective elements at such opposed longitudinally spaced apart points to mount the linear means operatively therebetween for connecting the elements in resilient suspension relation.

Ferrule means are advantageously provided for anchoring on opposed retaining means ends of the linear means against longitudinal movement therebetween. Such ferrule means may be swaged on ferrule means and the adjacent areas between the ferrule means and the corresponding ends of the linear means may be filled with anchoring material to provide a tight anchoring fit thereat. Other appropriate anchoring means may also be used.

In accordance with a particular feature of the present invention the elements are provided in the form of a pair of internested telescoping elements defining a shock absorber chamber operatively therewithin of longitudinally varying dimension in dependence upon the reciprocal displacement of the elements with respect to each other. The resilient tension shock absorbing means advantageously are operatively interposed in the chamber.

The chamber is preferably sealed off from direct or open flow communication with the exterior of the device and contains a lubricant. Suitably, such lubricant is maintained in operative lubricating contact with the mechanical resilient tension shock absorbing means and preferably as well with the means, such as radial torque drive pins, used for interengagingly interconnecting the pair of slidably associated telescoping elements for common rotation and relative reciprocal displacement. In such instances, the lubricant may take the form of a flowable lubricant, e.g. a bath of liquid such as a high temperature resistant silicone oil.

Where such lubricant feature is provided, the device may be advantageously further equipped with pressure balancing means, such as an annular floater seal in an annular floater seal chamber located between the telescoping members, for maintaining the shock absorber chamber in indirect pressure flow-communication with the exterior of the device, whereby to balance the pressure in the shock absorber chamber with respect to the ambient exterior pressure in the well bore.

However, optionally a portion of the interior of the device operatively between such elements may be provided in selectively restricted open flow communication with the exterior of the device for exerting a counter pressure operatively therebetween corresponding to the ambient external pressure of the external drilling fluid in the well bore for desired purposes, as the artisan will appreciate.

In accordance with a particular embodiment of the invention, the elements include an inner tubular mandrel and outer tubular housing together defining an annular shock absorbing chamber transversely therebetween, with the resilient tension shock absorber means including a plurality of longitudinally resilient tension shock absorbing linear members disposed in peripherally spaced apart relation to each other and commonly interconnecting the elements at such opposed longitudinally spaced apart points and arranged in the chamber to absorb under tension longitudinally therethrough the dynamic longitudinal stress in question.

Suitably, the mandrel is provided with a central drilling fluid supply bore defined therethrough. In such case a sealing means is provided to seal off the mandrel bore and the chamber from flow communication with each other.

In accordance with a further preferred feature of the invention, the retaining means correspondingly include a pair of opposed ferrule mounting and linear member end receiving retaining rings having medially facing abutment surfaces or lands. Correspondingly, the elements include opposed remotely facing seating shoulders to mount the abutment surfaces or lands of the retaining rings. Accordingly, dynamic longitudinal stress acting through one of the elements may be transmitted via the seating shoulder thereof and the abutment surface of the ring thereat to the adjacent ends of the respective linear members through the corresponding ferrule means and in turn under tension shock absorbing action from the opposite ends of such linear members through the other ferrule means to the other of such elements adjacent thereto via the seating shoulder thereof and the abutment surface of the ring thereat. Consequently, the elements are suitably maintained in longitudinal resilient suspension relation. Preferably, in this regard, the corresponding ends of the linear members at the retaining ring of the other of such elements are suitably fixed against longitudinal movement with respect to such other of the elements, whereby the longitudinal linear members are permitted longitudinal play only at the correspondingly remote ends thereof.

More particularly, the mandrel associated retaining ring is provided with a radially outer edge having a plurality of radially outwardly directed receiving slots or grooves disposed therein in circumferentially spaced apart relation to each other and the housing associated retaining ring is provided with a radially inner edge having a like plurality of radially inwardly directed receiving slots or grooves disposed therein in circumferentially spaced apart relation to each other. Hence, the plurality of linear members can be efficiently mounted, positioned and contained at their corresponding ends in the receiving slots of the opposed retaining rings for the desired purposes. In turn, the resulting convoluted outer diameter and inner diameter retaining rings as the case may be provide abutment surfaces or lands having sufficient surface area for the ferrule means to rest on, whereby to develop greater work area distribution than otherwise and consequently less force per unit area under dynamic shock absorbing load. This construction enables assembly of the linear members with pre-attached ferrule means on the rings to be effected in an efficient manner for positioning in turn operatively between the elements at the corresponding shoulders thereof.

In the usual way, the mandrel and housing are provided with coacting spline portions for interengagingly interconnecting such elements for common rotation and for selectively limited relative reciprocal displacement longitudinally with respect to each other. Thus, where the mandrel and housing spline parts are provided as coacting pin receiving spline portions, radial torque drive pins may in turn be disposed in such coacting spline portions to achieve such interengaging interconnection of the two elements as noted above.

Referring to the drawings, and especially FIGS. 1*a* and 1*b*, the tension shock absorber device 1 includes an inner tubular mandrel 2 and an outer tubular housing 3, constituting a pair of telescoping slidably associated annular longitudinal elements extending along the common longitudinal axis 4. Mandrel 2 has a lower connection end 5, e.g. in the form of a bit sub, provided with a threaded portion 6 for connecting the mandrel to a drill bit (not shown) of the conventional type therebelow. Mandrel 2 also has an upper telescoping insertion end 7 and a central drilling fluid supply bore 8 for feeding drilling fluid in the usual manner therethrough to the bit sub end 5 and in turn to the drill bit therebelow.

Housing 3 is composed in tandem of the upper collar sub section 9, the cable housing section 10, the spline housing section 11 and the spline pin nut and mandrel guide section 12, extending from the upper end 13 provided with threaded portion 14 for connecting housing 3 to a component of a drill string (not shown) thereabove, to the lower telescoping receiving end 15. Housing 3 is furthermore provided with a slidably embracing reception bore 16 of stepped or irregular radial dimension therealong for accommodating the correspondingly irregular or stepped radial dimension of the mandrel exterior 17 disposed therealong.

The angularly offset radial, or more precisely frustoconical, orientation of the opposed abutment end faces or tapered lands between housing sections at 18, 19 and 20, as the case may be, enhances advantageously the structural and sealing integrity between these angular parts, inherently preventing axial wobble or radial play therebetween. In contrast, mandrel 2 may be provided as a one piece element without the need for any such interconnections. As the artisan will appreciate, however, the housing 3 may be provided with a lesser number of interconnecting sections, if desired, for example by appropriate modification of sections 9 and 10 to form a one piece element comprising such sections.

Housing 3 may be provided in section 11 with appropriately dimensioned female semi-cylindrical splines 21 and in turn mandrel 2 may be provided with cooperating female semi-cylindrical mandrel splines 22 of selectively increased length as compared with housing splines 21 (see FIGS. 1*b* and 2). Accordingly, the correspondingly longitudinally dimensioned radial torque drive pins 23 may be operatively inserted within the coacting housing splines 21 and mandrel splines 22 for interengagingly interconnecting mandrel 2 and housing 3 for common rotation and for selectively limited relative reciprocal displacement longitudinally with respect to each other. In this regard, pins 23 are fixed within housing splines 21 against both axial and radial movement whereas pins 23 are fixed within mandrel splines 22 only against radial movement while permitting axial movement along the increased longitudinal extent of the mandrel splines, e.g. as shown at 22*a*.

In order to accommodate pins 23, spline housing section 11 is provided with downwardly facing housing shoulders 24 and spline pin nut and mandrel guide section 12 is provided with appropriate upwardly facing housing shoulders 25, sections 11 and 12 being separate to permit proper insertion of the drive pin 23 in place, followed by rotation inwardly of section 12 within section 11 along threaded portion 26 to the desired extent. Lock pin 27 is suitably accommodated between sections 11 and 12 to maintain the desired relation between these parts.

In like manner, mandrel 2 is provided with downwardly facing shoulders 28 in radial alignment with housing shoulders 24 when mandrel 2 is selectively disposed at its outer most position with respect to housing 3, as shown in FIG. 1*b*.

Upon axially inward or upward movement of mandrel 2 within housing 3, the maximum displacement may be suitably controlled by appropriately dimensioning the opposed stop faces 29 and 30, respectively at housing 3 and mandrel 2 in the vicinity of the lower end 15 of the housing. These stop faces are annular in disposition and may be of any selective configuration as desired. Advantageously, therefore, in the unlikely event that the resilient tension shock absorbing means were to fail, these stop faces will contact each other prior to the adverse abutting together of any internal surfaces of the device.

Of course, as the artisan will appreciate, other means may be provided for limiting the relative longitudinal displacement between mandrel 2 and housing 3.

By reason of the staggered radial dimensions of the housing bore 16 and mandrel exterior 17, a suitable shock absorber chamber 31 is defined therebetween along a selective longitudinal extent, e.g. between the spline and pin interconnection portion of the device and the upper end thereof. Due to the relative reciprocal displacement between mandrel 2 and housing 3, such chamber 31 will longitudinally vary in dimension. The resilient tension shock absorbing means are provided in chamber 31, here shown in the form of mechanical resilient tension shock absorbing metal wire cables 32 such as metal wire rope cables, and in particular multiple strand steel rope. Ferrule means, preferably in the form of swaged on ferrule means 33 and 34 are provided at the corresponding ends of cables 32 for embracively anchoring such ends therein and against movement therebetween.

Alternatively, as shown in FIG. 6, the adjacent areas between the ferrule means 33*a* and the corresponding ends of the cables 32 may be filled with anchoring material 33*b* to provide a tight anchoring fit thereat. For this purpose, the ferrule means 33*a* may be suitably provided with a tapering bore 33*c* and the wires at the corresponding cable end appropriately flared, such that the adjacent area, e.g. filled with molten lead or zinc and then cooled, will assure a tight flared connection therebetween. The same arrangement is provided for the ferrule means 34*a* (not shown) at the opposite ends of the cables.

Corresponding opposed ferrule mounting and cable end-receiving retaining rings or collars 35 and 36 are provided on the mandrel and housing respectively, longitudinally inwardly of the ferrule means 33 and 34 respectively. Rings 35 and 36 (FIGS. 4 and 5) include medially facing abutment surfaces or lands 37 and 38 and remotely facing abutment surfaces or lands 39 and 40, and are provided with cable end receiving slots 35*a* and 36*a*. Specifically, the radially outer edge of the mandrel retaining ring 35 contains the radially outwardly directed receiving slots 35*a* in circumferentially spaced apart relation to each other, while the radially inner edge of the housing retaining ring 34 contains the radially inwardly directed receiving slots 36*a* in circumferentially spaced apart relation to each other.

In turn, housing 3 is provided with remotely facing seating shoulder 41 and mandrel 2 is provided with remotely facing seating shoulder 42 in opposed longitudinally spaced apart relation to the housing shoulder 41.

The cables 32 are thus longitudinally mounted at their corresponding ends in the receiving slots 35*a* and 36*a* with the adjacent ferrule means 33 and 34 in resting contact with the vicinal areas of the remotely facing surfaces or lands 39 and 40 at such slots, such that the remaining solid areas of the medially facing surfaces or lands 37 and 38 of the retaining rings 35 and 36 are maintained in resting contact in turn with the remotely facing seating shoulders 41 and 42 of the housing and mandrel. The ring slots or grooves 35*a* and 36*a* enable the cables or ropes 32 more or less to thread therethrough and lay therein whereby to facilitate the changing of the cables and permit easier assembly of the components. The remaining solid areas of the rings 35 and 36, on the other hand, serve for enhanced distribution of forces at the abutment surfaces 37 and 38 in continuous annular resting contact with the shoulders 41 and 42.

In this way, the cables 32 may be accommodated by being self-disposed completely within the chamber 31 for operatively bilaterally independently interconnecting mandrel 2 and housing 3 in longitudinal resilient suspension relation for absorbing under tension dynamic longitudinal stress corresponding to vibratory drill bit displacement shock or load acting upwardly at the lower end 5 or bit sub end of mandrel 2.

Specifically, such dynamic longitudinal stress will be transmitted (FIGS. 1*a* and 4) as a bit force along mandrel 2 via the remotely facing mandrel annular shoulder 42 to the medially facing abutment surface 37 of ring 35 for urging in upward direction the ferrule means 33 in resting contact with the remotely facing abutment surface 39 of such ring, whereby to place the cables 32 laying in the radially outwardly facing slots 35*a* under corresponding longitudinal tension. Such tension will in turn act (FIGS. 1*b* and 5) via the ferrule means 34 against the remotely facing abutment surface 40 of ring 36, with the cables laying in the radially inwardly facing slots 36*a*, for urging the medially facing abutment surface 38 of ring 36 against housing annular shoulder 41 under the counter-force represented by the relatively static collar weight resting on the upper end 13 of housing 3 during rotation of the system.

It will be seen, in this regard, that mandrel shoulder 42 and housing shoulder 41 represent opposed longitudinally spaced apart points between which the tension effect of the linear means or cable means 32 will be limited. Proper coaction is assured because both the diametrical dimension of the respective ferrule means and the radial dimension between the inner and outer diameters of the retaining rings concordantly exceed the corresponding radial distance or annular width between mandrel 2 and housing 3 adjacent the appropriately radially offset levels of the mandrel and housing medially or longitudinally inwardly of such ferrule means and rings (see FIGS. 1*a*, 1*b* and 3).

In order to fix ferrule means 34 and ring 36 against longitudinal movement with respect to housing 3, washer 43 may be provided between the outer ends of the cables 32 and the ferrule means 34 thereat, on the one hand, and the adjacent portion of housing bore 16 there constituted as end face 44 on the spline housing section 11. Thus, spline housing section 11 may be rotated along the threaded portion 45 at cable housing section 10 to achieve tight connection between sections 10 and 11 and at the same time fixed abutment via housing end face 44 and washer 43 against the adjacent ends of cables 32 carrying ferrule means 34 and snugly received in the appropriate slots 36*a* of ring 36.

Figure 3:
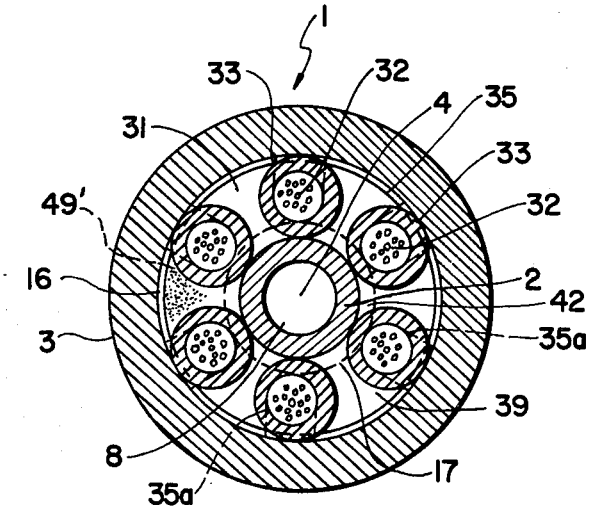

As will be appreciated more fully from FIGS. 3, 4 and 5, a plurality of cables and corresponding ring slots is provided, six being shown, such cables and slots being disposed in peripherally or circumferentially spaced apart relation to each other yet with the cables commonly interconnecting the mandrel and housing via the rings 35 and 36 at opposed longitudinally spaced apart points represented by mandrel shoulder 42, on the one hand, and housing shoulder 41, on the other hand. As the artisan will appreciate, any number of such cables and slots may be provided, depending upon the size of the shock absorber device and/or the appropriate size of the mandrel and its bore as the case may be. Nevertheless, the tension force to be accommodated by the linear means or cable means will influence the selection of the number of individual cables or other linear members provided, especially in terms of possible limits on the tension exerting properties of the particular linear means utilized, e.g. a cable means formed of multiple strand metal wire rope.

By suitably providing one or more vent ports 46 with a threaded portion 47, a removable plug or plugs 48, as the case may be, may be inserted thereat to seal off chamber 31 from the exterior of the device. In the latter instance, the sealed chamber may advantageously contain a flowable lubricant in operative lubricating contact with the cables 32, for example, throughout the entirety of the radial and axial extent of the annular chamber 31, e.g. as shown schematically at 49' in FIG. 3. The lubricant may be in the form of a bath of liquid such as a high temperature resistant silicone oil. Sufficient lubricant is desirably also present to occupy as well the annular area in the vicinity of the housing and mandrel splines 21 and 22 and the radial torque drive pins 23 for enhanced lubricating effect. Of course, the latter annular area is normally sealed off below from the remainder of the device at ends 5 and 15 thereof by appropriate seal means (not shown) of the conventional type to prevent undesired entry of extraneous matter thereinto from the exterior of the device.

In order to suitably prevent leakage of drilling fluid flowing downwardly through mandrel bore 8 from entering chamber 31 from above, an annular seal 49 may be provided in a recess 50 in housing 3 at collar sub section 9 held in place by a conventional seal nut 51. Accordingly, seal 49 will close off mandrel bore 8 and chamber 31 from flow communication with each other.

In this regard, collar sub section 9 and cable housing section 10 are suitably interconnected at threaded portion 52, the relative extent of section 9 inwardly of section 10 determining the upper end of chamber 31 and thus selectively the longitudinal dimension of the chamber between annular wall 53 and washer 43 in abutment with end face 44.

Additionally, by providing annular passage 54 and annular auxiliary chamber 55 between the mandrel and housing, the portion of the interior of the device thereat can be placed in selectively restricted open pressure flow-communication with the exterior of the device for the desired purposes. On the other hand, by providing annular floater seal 56 in chamber 55, the chamber 31, e.g. via the lubricant filling the same and the adjacent areas at the splines and pins and a portion of auxiliary chamber 55 appropriately communicating therewith above floater seal 56, can be maintained in indirect pressure flow-communication with the exterior of the device via passage 54. Thus, floater seal 56 serves as pressure balancing means for balancing the pressure in chamber 31 with respect to the ambient external pressure in the well bore. Fill plug 57 similar to plug 48 may be used for supplying lubricant as needed at a point above floater seal 56 for filling chamber 31, the annular area adjacent splines 21 and 22 and pins 23 (see FIGS. 1*b* and 2), the annular restricted channel 58 and the portion of annular auxiliary chamber or floater chamber 55 above floater seal 56. Floater seal 56 avoids the need for other seal means (not shown), e.g. in channel 58, to prevent extraneous matter from reaching the interior parts of the device.

Since the present invention contemplates mechanical resilient tension shock absorbing means, such may readily take the form of metal wire cable means such as multiple strand metal wire rope. Nevertheless, cables, rods, tubes, chains, etc. in any form, including those of metal or of plastic material such as nylon, i.e. any material that will suitably stretch within permissible functional and physical limits, may be used as the linear means or cable means for achieving mechanical resilient tension shock absorbing action under the stress loads contemplated during well bore drilling, according to the invention. Of course, the cable means may be relatively stiff or flexible, continuous as in the case of wire rope, rods, tubes, etc., or interrupted as in the case of links making up a chain, as the artisan will appreciate. The particular construction in question will preferably inherently be elevated temperature thermally stable in nature and thus serviceable for long lasting use in thermal wells such as those attaining temperatures even as high as 600° F. Such thermal stability is generally incapable of being achieved with the known non-mechanical types of shock absorbing agents such as those utilizing elastomeric materials, compressible liquids or compressible gasses as the shock absorbing medium. It will be noted that in connection with the alternate embodiment in which chamber 31 is a sealed chamber filled with a liquid, such liquid is not generally subject to excessive compressive forces since the relative reciprocal displacement of mandrel 2 within housing 3 will be predominately arrested by the tension action of the cables so as to avoid undue compression heating of any such confined liquid.

It will be appreciated from the foregoing that the instant mechanical resilient tension shock absorbing means will perform reliably at extremely high temperatures by reason of the system of wire rope cables or other linear means or members more or less suspended within the device in peripherally spaced apart relation within the annular separation defined by chamber 31, with the ends of each cable being appropriately nested, for example via the ferrule means 33 and 34 and the retaining slots 35*a* and 36*a* of the interposed convoluted outer or inner diameter rings 35 and 36, in a pocket or shoulder as constituted by the appropriate radially extending mandrel and housing annular shoulders 42 and 41, as the case may be. In essence, the mandrel represents a functional extension of the drill bit in terms of upward thrust acting through the cables or other linear means 32 and against the downward thrust of the substantially static collar weight exerted on the upper end of the housing. In a manner of speaking, the bit load is cradled on the cables and prevented from being transmitted vibrationally therethrough to the housing and in turn to the drill string components thereabove to an extent that would adversely affect the mechanical integrity of the operative drilling system.

It will be seen that just one seal, i.e. seal 49, need be provided to prevent the downward flow of drilling fluid or pump fluid from communicating through the device, i.e. at chamber 31, with the bore hole annulus at the immediate exterior of the device in the vicinity of the down hole end at which drilling is being effected. For example, such simple seal may be of the steam type packing with appropriate additives for achieving sufficient lubrication, as is well known to the art. Under most operating conditions, the pressure differential on such seal 49 will normally not exceed about 1200 psi although such seal may be constituted suitably to withstand pressures of up to 5000 psi and higher, if desired, to provide a safe margin of insurance against premature degradation or leakage.

The instant construction contemplates interconnected housing section parts which are provided so as to maintain rigidity and prevent loosening during drilling, i.e. as the composite device is being rotated by the overlying drill string. Since the mandrel is providable as a single unit, i.e. of one piece, loosening of its parts does not occur. Nevertheless, as the artisan will appreciate, soft wear sleeves (not shown) may be provided in the housing bore 16 in the vicinity of the upper end 7 of the mandrel and in the vicinity of the lower end 15 of the housing adjacent the outer face of the mandrel thereat to control more efficiently possible lateral deflection of the two tubular elements with respect to one another during operation.

As an example of a suitable type cable 32, a $\frac{5}{8}$ inch diameter standard wire rope cable with the conventional 6×37 strands of steel wire may be provided, for instance, having a metal area of 0.156 square inch plus an additional 15% for its stranded wire core, totalling 0.179 square inch effective cross-sectional area. Such cable has an ultimate strength of 34,000 lbs. although the cables according to the invention will normally only be loaded to about 40% or 13,600 lbs. working load per cable. In the case of six such cables, a total of 81,600 lbs. working load and a corresponding ultimate load limit of 204,000 lbs. can thus be achieved. Such cables advantageously possess approximate modulus of elasticity values of between about 10,000,000 to 14,000,000 psi.

Generally, the longer the cable length, the greater will be the cable stretch characteristics for a given diameter cable. Cables in the order of 5 to 15 feet in length are advantageously useable although longer or shorter length cables are possible. The overall diameter size of the cable will also influence the tension shock absorbing power as will the number of cables used, as the artisan will appreciate.

Thus, the present invention provides a unique mechanical tension shock absorbing system, involving a novel combination of a minimum of coacting parts in a simple and inexpensive construction, durable in use and extremely effective in damping vibrations acting via the drill bit through the mandrel, and essentially isolating such vibrations from the housing in resilient tension suspension relation therewith, more or less independently of the ambient thermal and pressure conditions at the drilling site. The inherently robust and durable mechanical tension shock absorbing system need not critically be sealed off from ambient drilling fluid or well bore mud, etc., and consequently concern with seals, packings, etc. is rendered minimal at most. Moreover, the tension shock absorbing power may be selectively adjusted by correspondingly adjusting the length and diameter of a given type cable and the number of such cables utilized, as the case may be.

Of course, where the pertinent linear means is a tube, rod, chain or the like instead of a wire rope, the ferrule means will similarly embracively anchor the corresponding tube, rod or chain end against movement therebetween, e.g. by suitable swaging or anchoring material filling of the ferrule means thereat, as desired, although other means may also be used to accomplish this task. For instance, an appropriately sized and shaped retaining pin may be fixedly positioned in diametrically aligned cross bores provided in the ferrule means for tight registry with a like diametrical cross bore in the tube or rod end or for corresponding engagement with the adjacent inner edge portion of the end link of the chain insertedly disposed thereat in the usual manner, as the artisan will appreciate.

It will be appreciated that the foregoing specification and drawings are set forth by way of illustration and not limitation, and that various modifications and changes may be made therein without departing from the spirit and scope of the present invention which is to be limited solely by the scope of the appended claims.

What is claimed is:

1. Shock absorber device for use in well bore drilling to absorb drill bit vibratory displacement shock comprising a pair of slidably associated longitudinal elements interengageably interconnected for common rotation about a longitudinal axis and for selectively limited relative reciprocal displacement longitudinally with respect to each other along such axis, with one of such elements being operatively connectable to a component of a drill string and the other of such elements being operatively connectable to a drill bit, and resilient tension shock absorbing means self-disposed completely within the device and interposed between such elements and operatively bilaterally independently interconnecting such elements in resilient suspension relation with respect to each other for absorbing under tension dynamic longitudinal stress corresponding to vibratory drill bit displacement shock acting through one of such elements.

2. Device according to claim 1 wherein such resilient tension shock absorbing means include longitudinally resilient mechanical tension shock absorbing linear means.

3. Device according to claim 2 wherein such linear means are in cable form.

4. Device according to claim 2 wherein such linear means are in rod form.

5. Device according to claim 2 wherein such linear means are in tube form.

6. Device according to claim 2 wherein such linear means are in chain form.

7. Device according to claim 2 wherein such linear means are composed of plastic material.

8. Device according to claim 2 wherein such linear means are composed of nylon.

9. Device according to claim 2 wherein such linear means are composed of metal.

10. Device according to claim 2 wherein such linear means are metal wire cable means.

11. Device according to claim 2 wherein such linear means are composed of multiple strand metal wire rope having a stranded wire core.

12. Device according to claim 2 wherein such linear means operatively interconnect such elements at opposed longitudinally spaced apart points and are arranged to absorb under tension longitudinally therethrough such dynamic longitudinal stress.

13. Device according to claim 1 wherein corresponding opposed retaining means are provided on the respective elements at such opposed longitudinally spaced apart points to mount the linear means operatively therebetween for interconnecting such elements in resilient suspension relation.

14. Device according to claim 13 wherein ferrule means are provided for embracively anchoring the corresponding ends of such linear means therein and against longitudinal movement therebetween to mount the linear means thereby operatively correspondingly on the opposed retaining means.

15. Device according to claim 14 wherein such ferrule means are in the form of swaged on ferrule means.

16. Device according to claim 14 wherein the adjacent areas between the ferrule means and the corresponding ends of such linear means are filled with anchoring material to provide a tight anchoring fit thereat.

17. Device according to claim 1 wherein such elements are provided in the form of a pair of internested telescopingly arranged elements defining a shock absorber chamber operatively therewithin of longitudinally varying dimension in dependence upon the reciprocal displacement of the elements with respect to each other, and the resilient tension shock absorbing means are operatively interposed in such chamber.

18. Device according to claim 17 wherein such chamber is a sealed chamber containing a lubricant in operative lubricating contact with such resilient tension shock absorbing means.

19. Device according to claim 18 wherein such lubricant is a high temperature resistant silicone oil.

20. Shock absorber device for use in well bore drilling to absorb drill bit vibratory displacement shock comprising a pair of slidably associated longitudinal elements interengageably interconnected for common rotation about a longitudinal axis and for selectively limited relative reciprocal displacement longitudinally with respect to each other along such axis, with one of such elements being operatively connectable to a component of a drill string and the other of such elements being operatively connected to a drill bit, and resilient tension shock absorbing means interposed between such elements and operatively interconnecting such elements in resilient suspension relation for absorbing under tension dynamic longitudinal stress corresponding to vibratory drill bit displacement shock acting through one of such elements, such resilient tension shock absorbing means including longitudinally resilient mechanical tension shock absorbing linear means operatively interconnecting such elements at opposed longitudinally spaced apart points and arranged to absorb under tension longitudinally therethrough such dynamic longitudinal stress, and such linear means including a plurality of longitudinally resilient tension shock absorbing linear members disposed in peripherally spaced apart relation to each other and commonly interconnecting such elements at such opposed longitudinally spaced apart points.

21. Shock absorber device for use in well bore drilling to absorb drill bit vibratory displacement shock comprising a pair of slidably associated longitudinal elements interengageably interconnected for common rotation about a longitudinal axis and for selectively limited relative reciprocal displacement longitudinally with respect to each other along such axis, with one of such elements being operativeley connectable to a component of a drill string and the other of such elements being operatively connectable to a drill bit, and resilient tension shock absorbing means interposed between such elements and operatively interconnecting such elements in resilient suspension relation for absorbing under tension dynamic longitudinal stress corresponding to vibratory drill bit displacement shock acting through one of such elements, such elements being provided in the form of a pair of internested telescopingly arranged elements defining a shock absorber chamber operatively therewithin of longitudinally varying dimension in dependence upon the reciprocal displacement of the elements with respect to each other, and the resilient tension shock absorbing means being operatively interposed in such chamber, and a separate portion of the interior of such device operatively between such elements being in selectively restricted open flow-communication with the exterior of the device for exerting a counterpressure operatively therebetween corresponding to the ambient external pressure.

22. Shock absorber device for use in well bore drilling to absorb drill bit vibratory displacement shock comprising a pair of slidably associated longitudinal elements interengageably interconnected for common rotation about a longitudinal axis and for selectively limited relative reciprocal displacement longitudinally with respect to each other along such axis, with one of such elements being operatively connectable to a component of a drill string and the other of such elements being operatively connectable to a drill bit, and resilient tension shock absorbing means interposed between such elements and operatively interconnecting such elements in resilient suspension relation for absorbing under tension dynamic longitudinal stress corresponding to vibratory drill bit displacement shock acting through one of such elements, such elements being provided in the form of a pair of internested telescopingly arranged elements defining a shock absorber chamber operatively therewithin of longitudinally varying dimension in dependence upon the reciprocal displacement of the elements with respect to each other, and the resilient tension shock absorbing means being operatively interposed in such chamber, such chamber being a sealed chamber containing a lubricant in operative lubricating contact with such resilient tension shock absorbing means, and pressure balancing means being provided for maintaining such chamber in indirect pressure flow-communication with the exterior of the device for balancing the pressure in the chamber with respect to the ambient external pressure.

23. Shock absorber device for use in well bore drilling to absorb drill bit vibratory displacement shock comprising a pair of slidably associated longitudinal elements interengageably interconnected for common rotation about a longitudinal axis and for selectively limited relative reciprocal displacement longitudinally with respect to each other along such axis, with one of such elements being operatively connectable to a component of a drill string and the other of such elements being operatively connectable to a drill bit, and resilient tension shock absorbing means interposed between such elements and operatively interconnecting such elements in resilient suspension relation for absorbing under tension dynamic longitudinal stress corresponding to vibratory drill bit displacement shock acting through one of such elements, such elements being provided in the form of a pair of internested telescopingly arranged elements defining a shock absorber chamber operatively therewithin of longitudinally varying dimension in dependence upon the reciprocal displacement of the elements with respect to each other, and the resilient tension shock absorbing means being operatively interposed in such chamber, and such elements including an inner tubular mandrel and an outer tubular housing together defining an annular shock absorber chamber transversely therebetween, and the resilient tension shock absorbing means including a plurality of longitudinally resilient tension shock absorbing linear members disposed in peripherally spaced apart relation to each other and commonly interconnecting such elements at opposed longitudinally spaced apart points and arranged to absorb under tension longitudinally therethrough such dynamic longitudinal stress.

24. Device according to claim 23 wherein corresponding opposed retaining means are provided on the mandrel and housing at such opposed longitudinally spaced apart points to mount the respective linear members operatively therebetween for interconnecting such elements in resilient suspension relation.

25. Device according to claim 24 wherein opposed ferrule means are provided for embracively anchoring the corresponding ends of each such linear member therein and against longitudinal movement therebetween to mount the linear members thereby operatively correspondingly on the opposed retaining means.

26. Device according to claim 25 wherein such retaining means correspondingly include a pair of opposed ferrule mounting and linear member end receiving retaining rings having medially facing abutment surfaces, and such elements correspondingly include opposed remotely facing seating shoulders to mount the abutment surfaces of the retaining rings for transmitting such dynamic longitudinal stress acting through one of such elements via the seating shoulder thereof and the abutment surface thereat to the respective linear members and in turn under tension shock absorbing from such linear members to the other of such elements via the seating shoulder thereof and the abutment surface thereat, with the elements being thereby maintained in resilient suspension relation.

27. Device according to claim 26 wherein the corresponding ends of the linear members at the retaining ring of the other of such elements are fixed against longitudinal movement with respect to such other of the elements.

28. Device according to claim 23 wherein the mandrel has a central drilling fluid supply bore defined therethrough.

29. Device according to claim 28 wherein sealing means are provided to seal off such mandrel bore and the chamber from flow-communication with each other.

30. Device according to claim 23 wherein the mandrel and housing are provided with coacting pin receiving spline portions therebetween and radial torque drive pins are provided in such spline portions for interengageably interconnecting such elements for common rotation and for selectively limited relative reciprocal displacement longitudinally with respect to each other.

31. Shock absorber device for use in well bore drilling to absorb drill bit vibratory displacement shock comprising a pair of telescopingly slidably associated tubular annular longitudinal elements extending along a common longitudinal axis, including an inner mandrel having a lower connection end for connecting the mandrel to a drill bit, an upper telescoping insertion end and a central drilling fluid supply bore, and an outer housing having a corresponding upper connection end for connecting the housing to a component of a drill string, a lower telescoping receiving end and a slidably embracing reception bore, said mandrel and housing being operatively interconnected for common rotation about such longitudinal axis and for selectively limited relative reciprocal displacement longitudinally with respect to each other along such axis, and together defining an annular shock absorber chamber radially therebetween of longitudinally varying dimension in dependence upon the reciprocal displacement of the mandrel and housing with respect to each other, sealing means operatively sealing off the mandrel bore and the chamber from flow-communication with each other, a pair of opposed retaining rings operatively disposed respectively on the mandrel and housing at opposed common longitudinally spaced apart points in the chamber, with the mandrel retaining ring having a radially outer edge provided with a plurality of radially outwardly directed receiving slots disposed in circumferentially spaced apart relation to each other and the housing retaining ring having a radially inner edge provided with a corresponding plurality of radially inwardly directed receiving slots disposed in circumferentially spaced apart relation to each other, and a corresponding plurality of axially extending and longitudinally resilient mechanical tension shock absorbing linear members in the chamber, disposed in circumferentially spaced apart relation to each other and mounted at their corresponding ends at the receiving slots of the opposed retaining rings, and commonly operatively interconnecting the mandrel and housing in longitudinally resilient tension suspension relation for absorbing under tension dynamic longitudinal stress corresponding to vibratory drill bit displacement shock acting through the mandrel.

32. Device according to claim 31 wherein opposed ferrule means are provided for embracively anchoring the corresponding ends of each such linear member therein and against longitudinal movement therebetween to mount the linear members thereby operatively correspondingly on the opposed retaining rings at the corresponding receiving slots thereof, and said retaining rings correspondingly include opposed medially facing abutment surfaces and such elements correspondingly include opposed remotely facing seating shoulders to mount the abutment surfaces of the retaining rings for transmitting such dynamic longitudinal stress acting through the mandrel via the seating shoulder thereof and the abutment surface thereat to the respective linear members and in turn under tension shock absorbing from such linear members to the housing via the seating shoulder thereof and the abutment surface thereat, with the mandrel and housing being thereby maintained in longitudinally resilient tension suspension relation.

33. Device according to claim 32 wherein the corresponding ends of the linear members at the retaining ring of the housing are fixed against longitudinal movement with respect to the housing.

34. Device according to claim 32 wherein a separate portion of the interior of such device operatively between the mandrel and housing is in selectively restricted open flow-communication with the exterior of the device for exerting a counter pressure operatively therebetween corresponding to the ambient external pressure.

35. Device according to claim 32 wherein such chamber is a sealed chamber containing a lubricant in operative lubricating contact with such linear members.

36. Device according to claim 35 wherein pressure balancing means are provided for maintaining such chamber in indirect pressure flow-communication with the exterior of the device for balancing the pressure in the chamber with respect to the ambient external pressure.

* * * * *